US006149376A

United States Patent [19]

Peting

[11] Patent Number: 6,149,376

[45] Date of Patent: Nov. 21, 2000

[54] PIPE MOVING METHOD, APPARATUS AND SYSTEM

[75] Inventor: Robert G. Peting, Oak Forest, Ill.

[73] Assignee: Amsted Industries Incorporated, Chicago, Ill.

[21] Appl. No.: 09/203,902

[22] Filed: Dec. 2, 1998

[51] Int. Cl.[7] ..... B22D 41/06

[52] U.S. Cl. ..... 414/746.3; 414/433; 414/745.8; 414/746.7; 414/746.8; 414/768; 414/772; 414/774; 414/777; 414/910; 414/22.65; 414/22.71; 148/594; 248/49

[58] Field of Search ..... 414/745.7, 745.8, 414/745.9, 746.3, 746.4, 746.5, 746.6, 746.7, 22.54, 22.56, 22.57, 22.62, 22.64, 22.65, 22.66, 22.68, 22.71, 768, 772, 774, 777, 784, 910, 433, 149, 684; 248/49; 148/590, 591, 594

[56] References Cited

U.S. PATENT DOCUMENTS

| | | | |
|---|---|---|---|
| 2,166,609 | 7/1939 | Putnam | 414/746.3 |
| 2,448,324 | 8/1948 | Pool | 414/22.57 |
| 2,495,093 | 1/1950 | Eckman | 414/746.7 |
| 2,865,516 | 12/1958 | Hedderich . | |
| 3,031,184 | 4/1962 | Spencer . | |
| 3,090,513 | 5/1963 | Handwerk et al. . | |
| 3,098,570 | 7/1963 | Lindemann | 414/746.3 |
| 3,463,410 | 8/1969 | Carpenter . | |
| 4,062,456 | 12/1977 | Birdwell . | |
| 4,129,221 | 12/1978 | Moller . | |
| 4,177,088 | 12/1979 | Pierrel . | |
| 4,253,792 | 3/1981 | Nishikawa | 414/910 |
| 4,303,270 | 12/1981 | Adair | 414/22.55 |
| 4,310,281 | 1/1982 | Egashira | 414/746.3 |
| 4,456,417 | 6/1984 | Gerding | 414/22.54 |
| 4,465,422 | 8/1984 | Blust, Sr. et al. | 414/433 |
| 4,699,564 | 10/1987 | Cetrangolo | 414/777 |
| 4,715,761 | 12/1987 | Berrey et al. | 414/22.65 |
| 5,263,545 | 11/1993 | Tudora et al. | 414/22.66 |
| 5,284,193 | 2/1994 | Mires et al. | 414/746.3 |
| 5,605,207 | 2/1997 | Betcher et al. | 414/910 |
| 5,667,342 | 9/1997 | Shutic et al. | 414/433 |

*Primary Examiner*—Douglas Hess
*Attorney, Agent, or Firm*—Edward J. Brosius; F. S. Gregorczyk; Stephen J. Manich

[57] ABSTRACT

A system, apparatus and method are disclosed for moving an elongate object such as a pipe between lowered and raised positions, preferably while rotating the object to maintain its shape. The system and method use two apparatuses, an upender and a downender for moving the pipe between lowered and raised positions. The upender tilts a lowered pipe received from a casting machine to the raised position and places the raised pipe on a support station. The pipe is rotated while on the upender through at least part of the range of travel. The upright pipe on the support station may be moved through an annealing furnace and then the downender may lift the pipe from the support station and tilt it downward toward the horizontal while rotating the pipe through part of the range of travel. The lowered pipe is then pushed off of the downender by kick off arms. Each apparatus has two different support systems for supporting the bottom end of the pipe, one support system being operable while the pipe is rotating and the other being operable while the pipe is non-rotating. A stabilizer is provided on each apparatus to prevent the pipe from tipping over as it is being tilted and moved onto and off of a support station. Rollers and roller drive mechanisms are provided on both apparatuses so that the pipes may be selectively rotated. Drives are also provided for moving the upender and downender apparatuses horizontally toward and away from support stations.

19 Claims, 11 Drawing Sheets

16
18
36
34
15
170
176
178
180
182
184
186
188
189
190
192
194
196
60
84
88
322
324
326
328

PIPE MOVING METHOD, APPARATUS AND SYSTEM

BACKGROUND OF THE INVENTION

1. Field of the Invention

The present invention relates to movement of products such as hollow cast metal pipe between production stations.

2. Description of the Prior Art

In the production of objects such as elongate cast metal pipes, centrifugal casting has been commonly used. In such a casting operation, the pipe is cast in a cylindrical mold. Molten metal, such as iron, is fed into the mold through a trough. The trough has a spout at one end which is curved toward the sidewall of the mold. A sand core is inserted into the bell end of the mold to form the inside contour of the pipe bell. The mold is rotated and once it is brought up to the appropriate speed, molten metal is poured into the trough. Once the bell end of the pipe has formed, the mold is moved horizontally while rotating. The stream of molten metal discharged from the spout flows tangentially onto the surface of the mold, where it is held in place by centrifugal force. The molten metal forms a homogeneous pipe with a cylindrical bore. By controlling the pouring rate and movement of the mold, the wall thickness of the pipe produced can be held within desired tolerances.

After the pipe has been completely cast, the mold is kept rotating until the pipe has cooled to a desired temperature. The pipe must then be taken from the casting machine and transferred to a heat treating furnace. The pipe is then moved through the heat treating furnace and heated and cooled to produce the desired properties in the finished pipe.

Pipes of different diameters have been produced in this manner. For example, ductile iron pipes of 8, 12, 14, 16, 18, 20 and 24 inches are common. For some applications, it is desirable to produce pipe of larger diameter, such as diameters ranging from 30–48 inches.

It is desirable to maintain pipe diameter within manufacturing tolerances. In addition, it is desirable to produce pipes having wall thicknesses within manufacturing tolerances. Both of these constraints are problematic in the case of large diameter pipe having diameters ranging from 30–48 inches. Moving the pipe between the casting production station and the heat treating furnace station, as well as treatment within the heat treating furnace, can result in the pipe going out-of-round or in the wall thicknesses changing due to the weight of the cast metal and the effects of gravity.

SUMMARY OF THE INVENTION

The present invention addresses the problem of moving an object such as a pipe between production stations and the problem of limiting undesirable deformation in the pipe by providing a system, method and apparatus for moving the object between lowered and raised positions.

DETAILED DESCRIPTION

Figure 1:
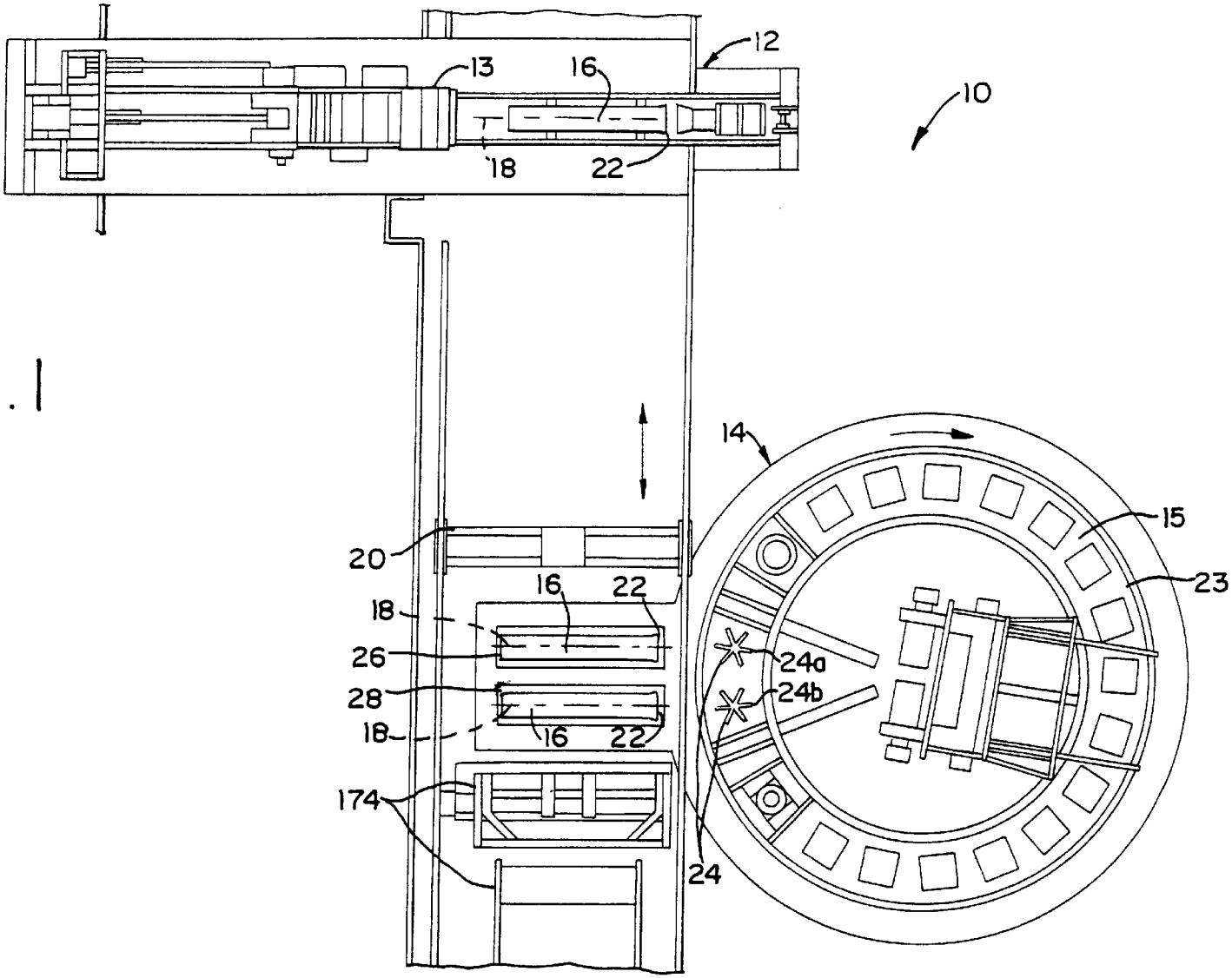
FIG. 1 is a top plan view, of an example of a pipe manufacturing facility illustrating the pipe casting station, heat treating station, and location of the pipe upender and downender of the present invention, with the parts simplified for clarity.

As shown in FIG. 1, a typical manufacturing facility 10 for manufacturing an elongate product such as ductile iron pipe includes spaced production stations 12, 14. One production station 12 in a pipe manufacturing facility usually comprises a casting station, which may include any centrifugal casting machine 13 known in the art. For a pipe manufacturing facility, the second production station 14 includes an annealing or heat treating furnace 15, where the cast ductile iron pipe is heated and cooled to produce the desired properties in the metal. In the illustrated embodiment, the second production station 14 also includes a carousel 23 with twenty-one support stations 24 for supporting pipe and moving the pipe into, through and out of the annealing furnace 15.

The pipe 16 at the casting station 12 that has exited the casting machine 13 is disposed with its central longitudinal axis 18 in a substantially horizontal position, typically at a small incline. To move the pipe from the casting station 12 to the heat treating station 14, an overhead crane 20 is provided. The overhead crane lifts the pipe from the casting station 12 or from some intermediate position and moves the pipe toward the next production station 14. Typically, the overhead crane transports the pipe in a substantially horizontal position.

In the illustrated embodiment, the manufacturing facility 10 is designed for the production of large diameter pipe, having diameters in the range of about 30–48 inches. To maintain the desired symmetry of the pipe and the desired uniformity of pipe diameter, the overhead crane 20 may be provided with a set of rollers and drive mechanism to rotate the rollers and to thereby rotate the pipe 16 about its central longitudinal axis 18 as it is moved by the crane 20. With the pipe rotating, undesirable deformation of the pipe should be limited. It should be understood that any standard overhead crane or other device could be used, although one providing for pipe rotation is preferred.

To further limit deformation of the pipe during the annealing process, in the system of the present invention the annealing furnace at the second production station 14 is designed to process pipes that are oriented with their bell ends 22 on support stations 24, the pipes being substantially upright. Each support station 24 is supported on the annular carousel 23 that is indexed through the heating and cooling sections of the annealing furnace 15. Thus, in the illustrated embodiment, each support station 24 moves in a complete circle into and through the annealing furnace.

Figure 2:
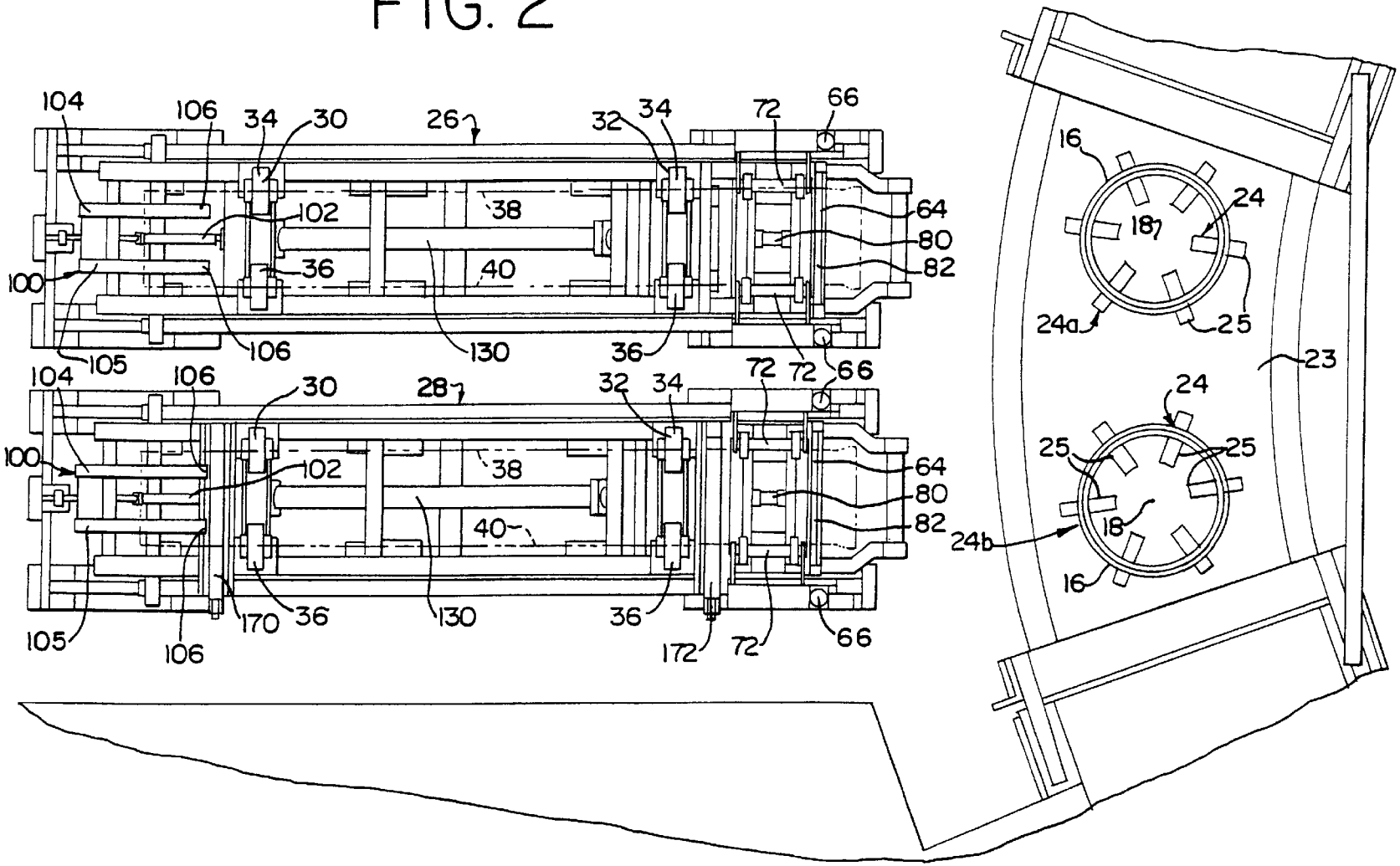
FIG. 2 is a top plan view of the pipe upender and pipe downender of FIG. 1, along with two pipe support stations.

In the illustrated embodiment, each support station 24 includes a plurality of spaced rails 25 that extend radially outward from an open central circle, as shown in FIG. 2. In the illustrated embodiment, there are six evenly-spaced rails 25 at each support station 24 forming a radial array, with an angle of about 60° between the center lines of adjacent rails. The diameter of the radial array of the support station from end to end of diametrically opposed rails is greater than 48 inches, the anticipated largest diameter of pipe to be treated in the annealing furnace. It should be understood that although FIG. 1 shows the radial array of rails 25 for the support stations at first and second locations 24*a*, 24*b*, all of the support stations 24 on the carousel have the same construction. For each support station, the top surfaces of the rails define co-planar substantially horizontal support surfaces for the pipes. It should also be understood that the illustrated structure and layout of the support station is provided by way of example only; other structures and layouts may be utilized; for example, rails may be positioned in an array other than radial.

To utilize the illustrated annealing furnace and standard cranes and conveying equipment, it is necessary to turn the pipe to the upright position for processing in the annealing furnace, and then to remove the upright pipe from the support station 24 after the annealing process has been completed.

The present invention provides an apparatus, system and method for moving the pipe 16 between raised and lowered positions, preferably while limiting any deformation that could occur due to the effects of gravity on the hot pipe. The system of the present invention includes a pipe upender 26 and a pipe downender 28. The upender 26 is between the first production station 12 and second production station 14. The downender 28 is downstream of the second production station 14. The upender 26 is aligned adjacent to a support station 24 shown at a first location 24*a* in FIGS. 1–2. The downender 28 is aligned adjacent to a support station 24 at a second location 24*b* shown in FIGS. 1–2. The first location 24*a* is upstream of the annealing furnace 15 part of the second production station 14 and the second location 24*b* is downstream of the annealing furnace 15 part of the second production station 14.

Figure 3:
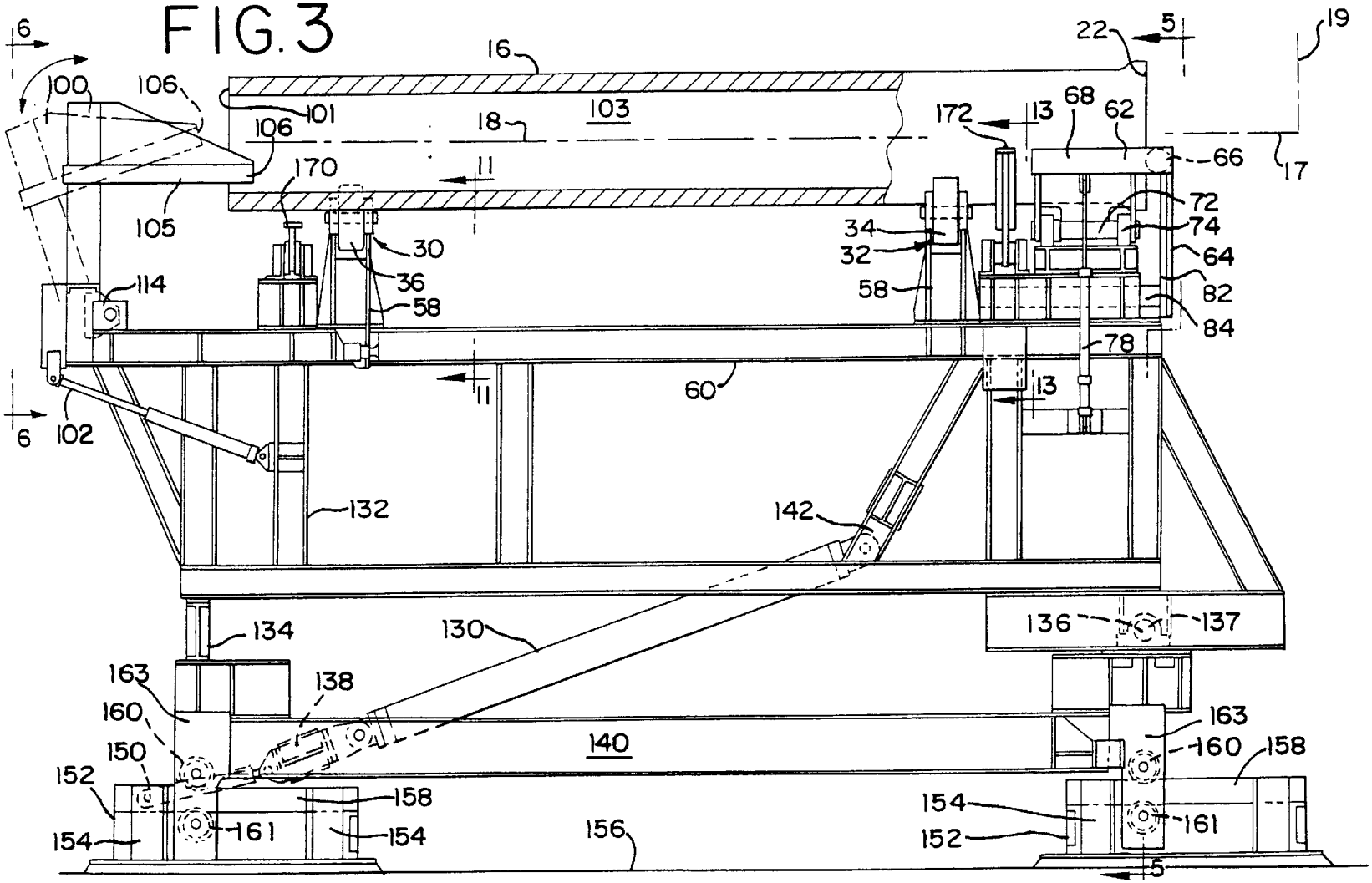
FIG. 3 is a side elevation of the pipe downender shown with a pipe in a lowered position, and with parts removed for clarity.
Figure 4:
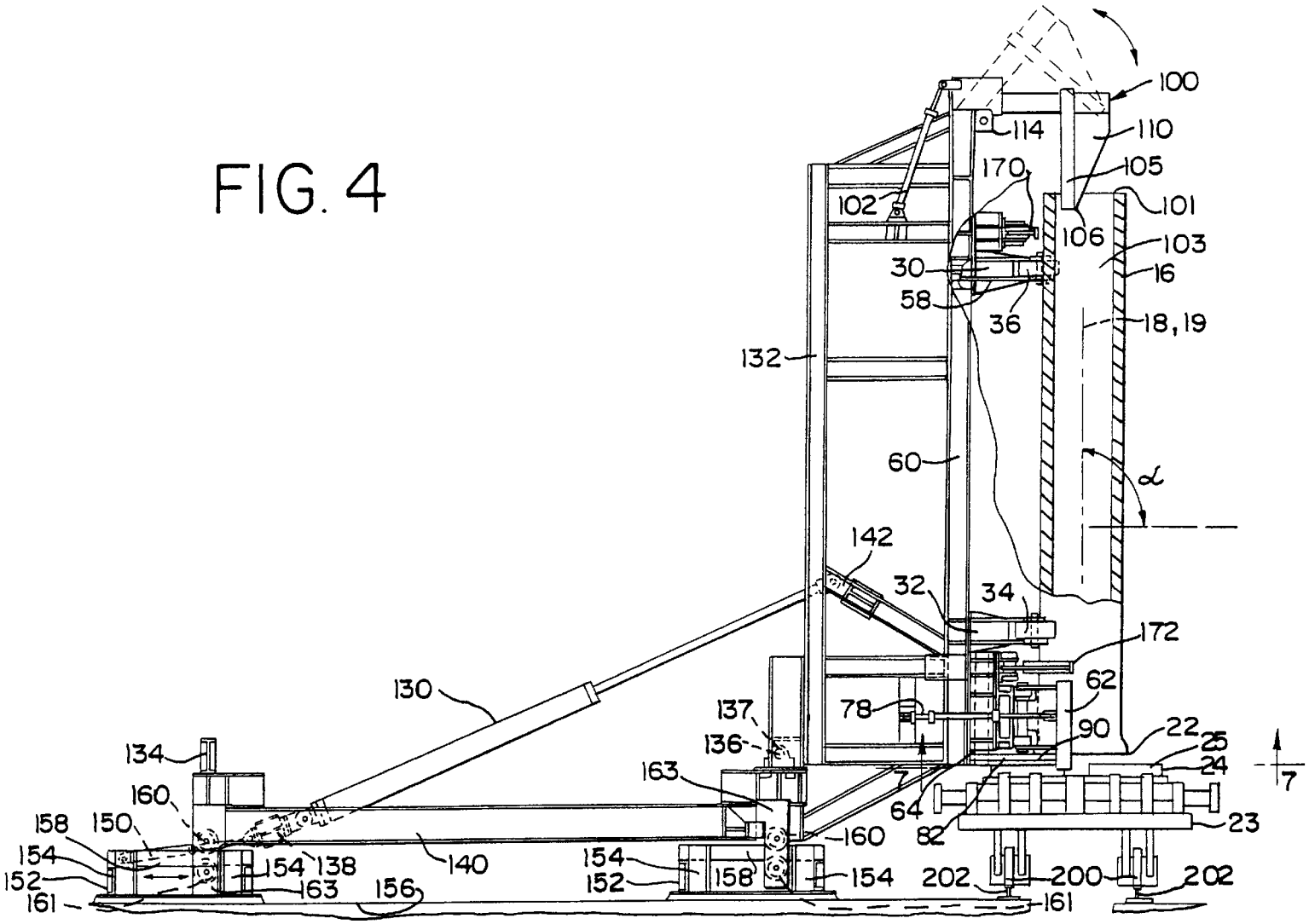
FIG. 4 is a side elevation of the pipe downender shown with the pipe in a raised position overlying one of the support stations, with parts removed for clarity.

The raised and lowered positions of the pipe 16 are the same for the upender 26 and downender 28 in the illustrated embodiment. The lowered position is shown in FIG. 3 and the raised position is shown in FIG. 4. As discussed below, in the raised position, the pipe may be aligned over one of the support stations 24, as shown in FIG. 4, and moved horizontally away from the support station 24.

The pipe upender 26 receives the pipe 16 from the crane 20 in the lowered position with the central longitudinal axis 18 of the pipe at a first angle with respect to a horizontal reference, shown at 17 in FIGS. 3–4, and tilts the pipe upward toward vertical to the raised position where the central longitudinal axis 18 of the pipe is at a second angle with respect to the horizontal reference 17. The second angle is shown at $\alpha$ in FIG. 4, and the vertical reference is shown at 19 in FIGS. 3–4. In the lowered position, the central longitudinal axis 18 of the pipe 16 is non-vertical, and may be substantially horizontal as shown in FIG. 3. Since the first angle is 0° in the illustrated embodiment, the first angle is not shown on FIGS. 3–4. When the pipe is at the second angle $\alpha$, the upender moves forward horizontally toward the support station at the first location 24*a* and places the upright pipe on the support station 24. The annular carousel 23 and support station 24 carrying the pipe 16 are then indexed through the heating and cooling sections of the annealing furnace 15. The annular carousel 23 and support station 24 carrying the pipe then exit the annealing furnace and reach the second location 24*b*. When the pipe and support station have reached the second location 24*b*, the downender 28 is moved forward toward the support station and lifts the substantially upright pipe off of the support station as shown in FIG. 4 and then tilts the pipe downward to a different angle.

In the illustrated embodiment, in the lowered position, that is, as the pipe is received by the upender 26, the central longitudinal axis 18 is substantially horizontal and the first angle is about 0° from the horizontal reference 17. In the raised position, the pipe is substantially upright and the central longitudinal axis 18 is substantially vertical so that the second angle $\alpha$ is about 90° from the horizontal reference 17. When the downender 28 is tilted down toward the horizontal reference 17 to place the pipe in a non-upright position, the central longitudinal axis 18 of the non-upright pipe is substantially horizontal, at a final angle of about 0°. It should be understood that the first angle may be larger than 0°, depending on the design of the overhead crane and upender, and that the first angle may comprise any angle within a range of angles. Similarly, the final angle of the pipe on the downender may be larger than 0°, depending on the design of the downender 28 and the conveying apparatus receiving the pipe from the downender.

Generally, the position of the object on the support station may include any orientation that serves the purposes of maintaining adequate balance of the object as it is moved through the second production station and that maintains the shape of the object within manufacturing tolerances, an orientation that may be designated the processing position. In the illustrated embodiment, the pipe is upright with its central longitudinal axis 18 vertical in the processing position. For the illustrated embodiment, the processing position of the pipes is shown in FIG. 2. The upender 26 serves to tilt the object toward the vertical reference 19 and toward this processing position; the upender may operate alone to tilt the object to the processing position so that the angular orientation of the pipe in the raised position on the upender coincides with the angular position of the pipe in the processing position on the support station; thus, in the raised position, the angle $\alpha$ may be about 90°. Or the upender 26 could be used in combination with some other device, with the upender 26 tilting the object upward to the raised position and the other device moving the object from the raised position to the processing position. The downender 28 may also operate alone to tilt the object from the processing position to the lowered position, or may be used with another device so that the downender tilts the object through a portion of the desired range of motion.

Both the upender 26 and the downender 28 tilt the pipes about axes different from the central longitudinal axes 18 of the pipes 16. In both the upender 26 and downender 28, the tilt axis is a substantially horizontal axis, comprising a pivot on both apparatuses. The pivot is shown at 136 and the tilt axis at 137 in FIGS. 3–4 and are described in more detail below.

Preferably, the upender 26 and downender 28 both also provide for rotation of the pipes 16 about their central longitudinal axes 18. It is also preferable that the rotation about the pipe axes 18 be simultaneous with tilting of the pipes about axis 137 through a plurality of angles. With the apparatuses of the present invention, rotation may be substantially continuous between tilt angles of about 0–75° from the horizontal. With such rotation of the pipes, deformation of the pipes during tilting is limited.

The pipe upender 26 and downender 28 are of substantially similar construction, and like reference numbers have been used for like parts in the drawings and in the description. The downender 28 includes two kick off arms 170, 172 and kick off arm drive mechanisms 190, described below, that are not provided on the upender in the illustrated embodiment.

The illustrated upender 26 and downender 28 are capable of being used with pipes of varying diameters, for example, ranging from 30–48 inches. Pipes 16 of two such varying diameters are illustrated in phantom in FIGS. 5–7, 11 and 13.

Figure 11:
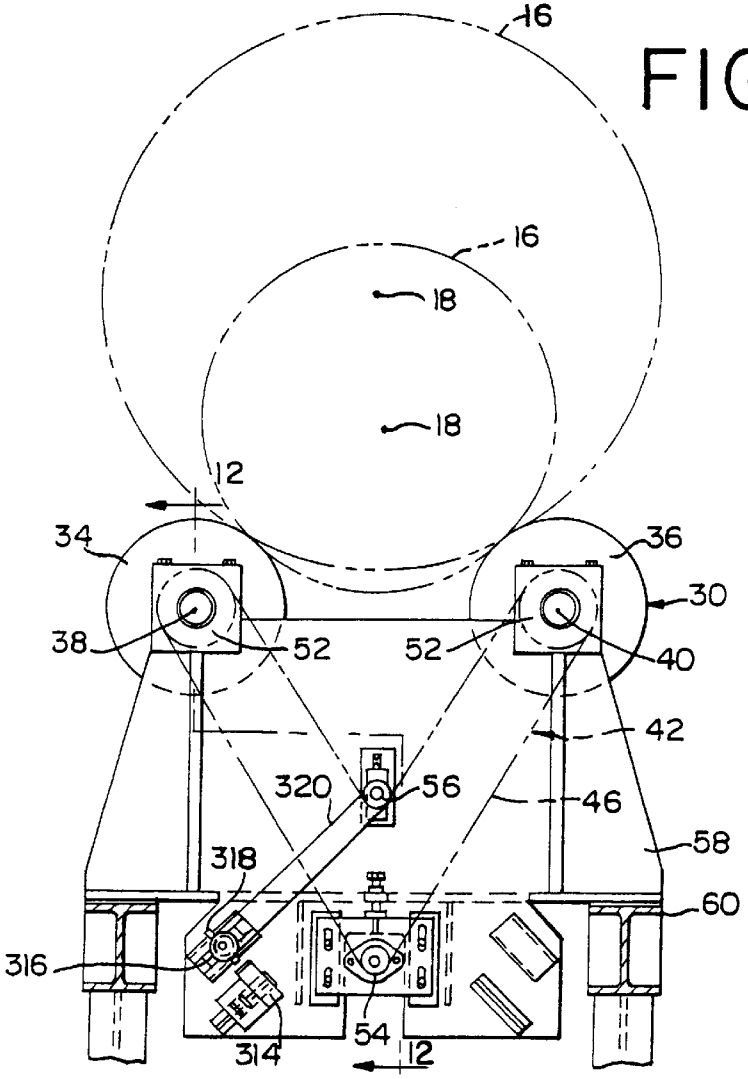
FIG. 11 is a cross-section taken along line 11—11 of FIG. 3, showing the rotator of the pipe upender and downender.

As shown in FIG. 2, the upender 26 and downender 28 each include first and second spaced rotators 30, 32. As shown in FIGS. 2 and 11, each rotator 30, 32 has two spaced rollers 34, 36. The spaced rollers 34, 36 of each rotator 30, 32 have spaced parallel axes of rotation 38, 40. The axis of rotation of one roller of each rotator is aligned to be co-linear with the axis of rotation of one roller of the other rotator. As shown in FIG. 11, when a pipe 16 is placed on the pipe upender 26, the outer circumferences of the rollers contact the outer surface of the pipe, and the central longitudinal axis 18 of the pipe 16 is positioned between and parallel to the axis of rotation 38, 40 of the rollers. The pipe upender and downender allow this positioning for pipes of varying diameters, as shown in FIG. 11. The rollers 34, 36 support and selectively rotate the pipe 16 about is central longitudinal axis 18.

Figure 12:
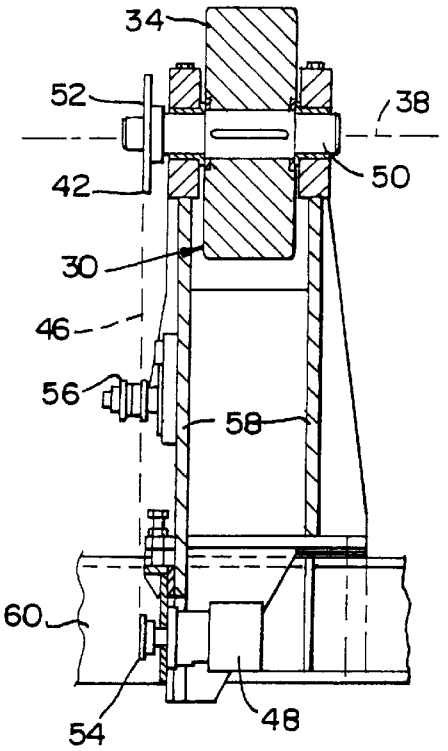
FIG. 12 is a cross-section taken along line 12—12 of FIG. 11, showing the rotator and a roller drive mechanism.

Both the upender 26 and the downender further include roller drive mechanisms for selectively causing the rollers 34, 36 to rotate. An example of a suitable roller drive mechanism is shown at 42 in FIG. 11, and it should be understood that such a drive mechanism 42 may be used for each rotator 30, 32 on both the upender 26 and the downender 28. The illustrated roller drive mechanisms 42 each comprise a drive chain 46 and a motor 48 to drive the drive chain. In the illustrated embodiment, as shown in FIG. 12, the rollers 34, 36 are each press fit onto a shaft 50 that is fixed to rotate with rotation of a roller sprocket 52. The hydraulic motor 48 is connected to drive a drive sprocket 54. The drive chain 46 extends around the drive sprocket 54, each roller sprocket 52 and a positioning sprocket 56. As the motor 48 moves the drive sprocket 54, the chain 46 moves to rotate the roller sprockets 52 which in turn rotate the rollers 34, 36. The outer surfaces of the rollers 34, 36 are in contact with the outer surface of the pipe, and rotation of the rollers thereby causes the pipe 16 to rotate about its central longitudinal axis 18. Each rotator 30, 32 also includes a pair of support walls 58 through which the rollers are connected to a frame 60 of the upender 26 or downender 28.

Any suitable materials may be used for the rotators and the roller drive mechanisms. In the illustrated embodiment, the rollers 34, 36 each comprise a 16 inch diameter steel wheel with a hardened surface. Since the outer surfaces of the rollers will be contacting the high temperature pipes, at temperatures potentially in excess of 1300° F., the rollers should be made of a suitable material. A suitable hydraulic motor is a CHAR-LYNN hydraulic motor, S Series, CHAR LYNN No. 103-2040, available from Macmillan Hydraulic Engineering Corp. of Skokie, Ill., an EATON CHAR-LYNN distributor.

It should be understood that the structures and particular types of rotators and roller drive mechanisms are identified for purposes of illustration only. The present invention is not limited to any particular type or structure of rotator or roller drive mechanism. It should also be understood that the provision of rotators and roller drive mechanisms is preferred for the illustrated application, but that there may be applications where rotation of the object is not necessary; the present invention is not limited to rotation of the pipe or other object unless expressly set forth in the claims.

Both the illustrated upender 26 and downender 28 also include rolling and non-rolling lower supports 62, 64 operable at different stages of the movement of the pipe 16 between the lowered and raised positions. Generally, the rolling lower pipe support 62 is operable while the pipe is rotating, and the non-rolling lower pipe support 64 is operable while the pipe is not rotating. Although one example of a rolling lower support 62 and non-rolling lower support 64 are described below, it should be understood that the description applies to the lower supports 62, 64 on both the illustrated upender 26 and downender 28.

Figure 5:
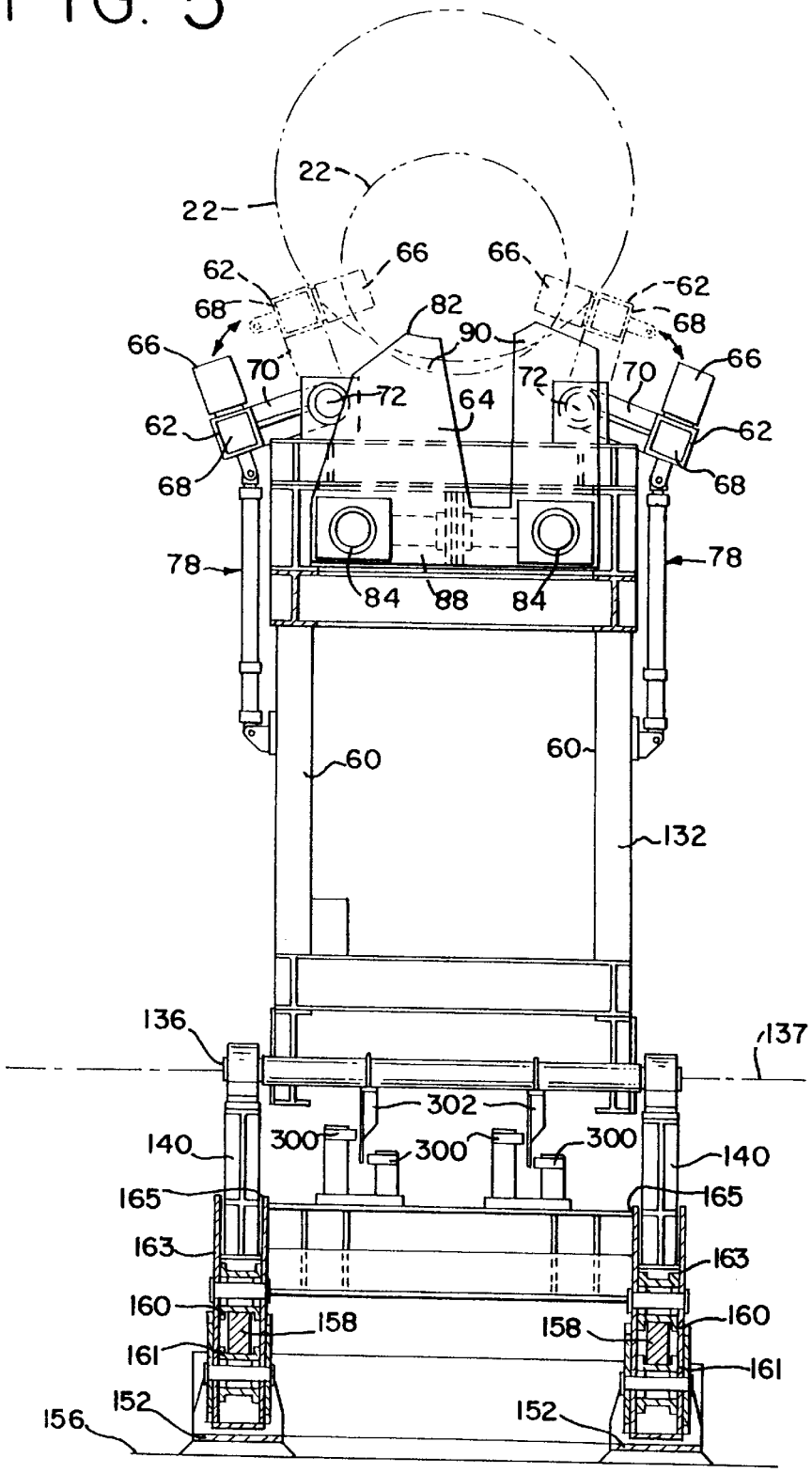
FIG. 5 is an end view taken along line 5—5 of FIG. 3, with parts removed for clarity.

An example of a suitable rolling lower pipe support 62 is shown in FIG. 5. As there shown, each rolling lower pipe support 62 includes a pair of rollers 66. The rollers 66 are moveable into a position wherein the outer surfaces of the rollers contact the bell end 22 of the pipe 16. The rollers 66 are idler rollers, mounted on shafts for free rotation about axes that are substantially perpendicular to the axes of rotation 38, 40 of the rotator rollers 34, 36.

The shafts of the rolling lower pipe support 62 are fixed through bushings to a support channel member 68. The support channel member 68 is fixed to a pair of arms 70 that are fixed to a rotatable shaft 72. The rotatable shaft 72 is connected to the frame 60 through bushings 74. As shown in FIG. 5, the rolling lower support is movable between a plurality of positions by pivoting the rollers 66 about the rotatable shaft 72 toward and away from the longitudinal axis 18 of the pipe 16 on the upender 26 or downender 28. Thus, the rollers may be either under the bell end 22 of the pipe 16 or spaced to be out of contact with the pipe. A drive mechanism 78 is provided to selectively move the rolling lower support 62 between these positions. The illustrated lower drive mechanism comprises a hydraulic drive, although it should be understood that any suitable drive may be used. One example of a suitable hydraulic drive is a cylinder with a 2 inch bore, 21½ inch stroke, 1⅜ inch diameter rod, rated 2200 p.s.i. severe service, available from Parker Hannifin Corporation of Cleveland Ohio. It should be understood that this drive is identified for purposes of illustration only, and that other devices may be used. In the illustrated embodiment, the hydraulic drive cylinder is pivotally connected to the support channel member 68 and the hydraulic drive rod is pivotally connected to the frame 60 of the upender.

It should be understood that the provision of a rolling lower support 62 is preferred, but that there may be applications where rotation of the object is not necessary, or where rotation only takes place while the object is substantially horizontal, in which case a rolling lower support would not be necessary. The present invention is not limited to provision of a rolling lower support unless expressly set forth in the claims. It should also be understood that the particular structure of the illustrated rolling support and rolling support drive mechanism are provided by way of example only, and that there may be other structures that will fulfill this function.

The non-rolling lower pipe support 64 is provided to support the bell end of the pipe 16 when the pipe is not rotating, such as when the pipe is vertical up to about 15–25° from the vertical. The non-rolling lower pipe support 64 is movable between a position where it contacts the bell end of the pipe and another position spaced from the bell end of the pipe. In the illustrated embodiment, the movement of the non-rolling lower pipe support is in a direction parallel to the central longitudinal axis 18 of the pipe 16 on the upender 26 or downender 28. The upender and downender both include drive mechanisms 80 to selectively move the non-rolling lower pipe supports 64 between these positions. Generally, when the rolling lower pipe support 62 is in position with its rollers 66 at the bell end of the pipe, the non-rolling lower pipe support 64 is spaced away from the bell end; when the pipe is not rotating, the bell end rests on the non-rolling lower pipe support 64 and the rollers 66 of the rolling pipe support 62 are pivoted out of the way.

Figure 8:
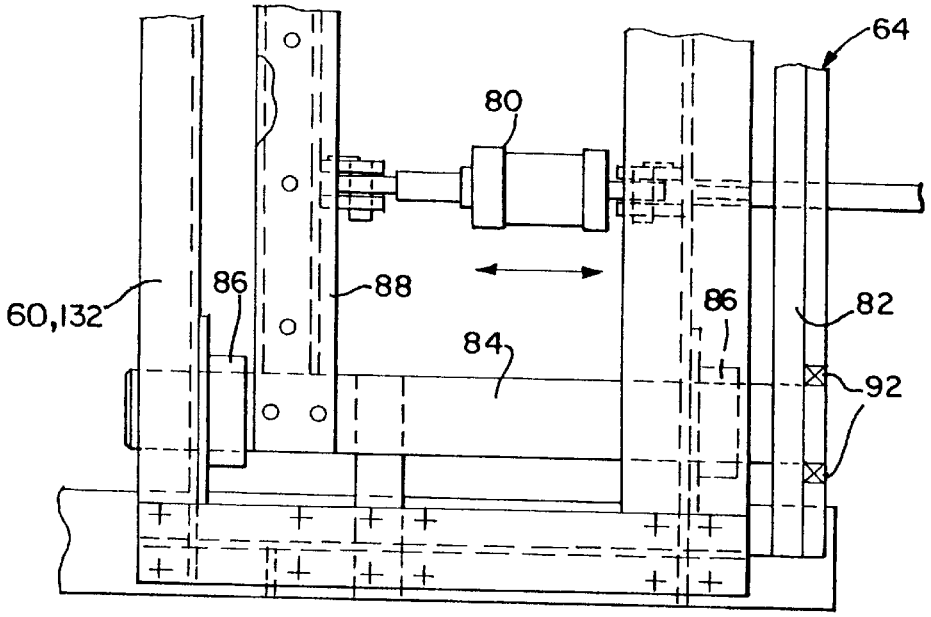
FIG. 8 is an enlarged plan view showing the non-rolling lower support and non-rolling lower support drive mechanism.
Figure 9:
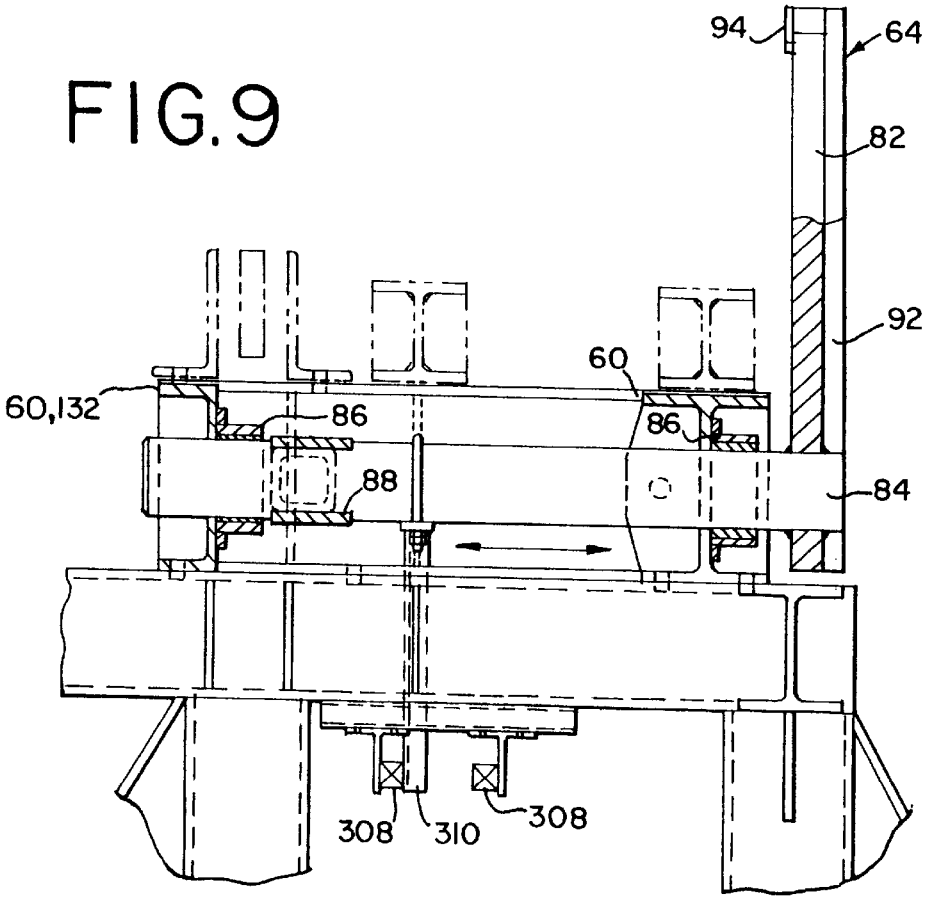
FIG. 9 is an enlarged detail elevation of the non-rolling lower support and non-rolling lower support drive mechanism with parts shown in section.

As shown in FIGS. 2–5 and 8–9, each non-rolling lower pipe support 64 includes a lower support plate 82. As shown in FIGS. 8–9, each lower support plate 82 is connected by welding or the like to a pair of spaced mechanical tubes 84. The mechanical tubes 84 are each received in a pair of spaced bushings 86 so that the tubes 84 may slide up and down through the bushings 86. The bushings 86 are fixed to the frame 60 of the upender or downender. A channel member 88 extends between and is fixed to the two mechanical tubes 84. The channel member is connected to the drive mechanism 80 for the non-rolling lower support 64.

A suitable drive mechanism 80 for the non-rolling lower pipe support 64 comprises a hydraulic drive. A suitable hydraulic drive has a cylinder with a 4 inch bore, 3 inch stroke 1¾ inch diameter rod, 1850 p.s.i. severe service device available from the Parker-Hannifin Corporation of Cleveland, Ohio. It should be understood that this drive mechanism is identified for purposes of illustration only, and that the invention is not limited to this particular device. The drive mechanism 80 is connected to both the channel member 88 and the frame 60, and operates to move the channel member 88 and connected mechanical tubes 84, so that the mechanical tubes 84 slide linearly through the bushings 86 along lines parallel to the central longitudinal axes 18 of the pipes 16 on the upender and downender. Thus, the support plate 82 is moved linearly between a plurality of positions so that its support surface is moved closer to or further away from the bell end 22 of the pipe 16.

Figure 7:
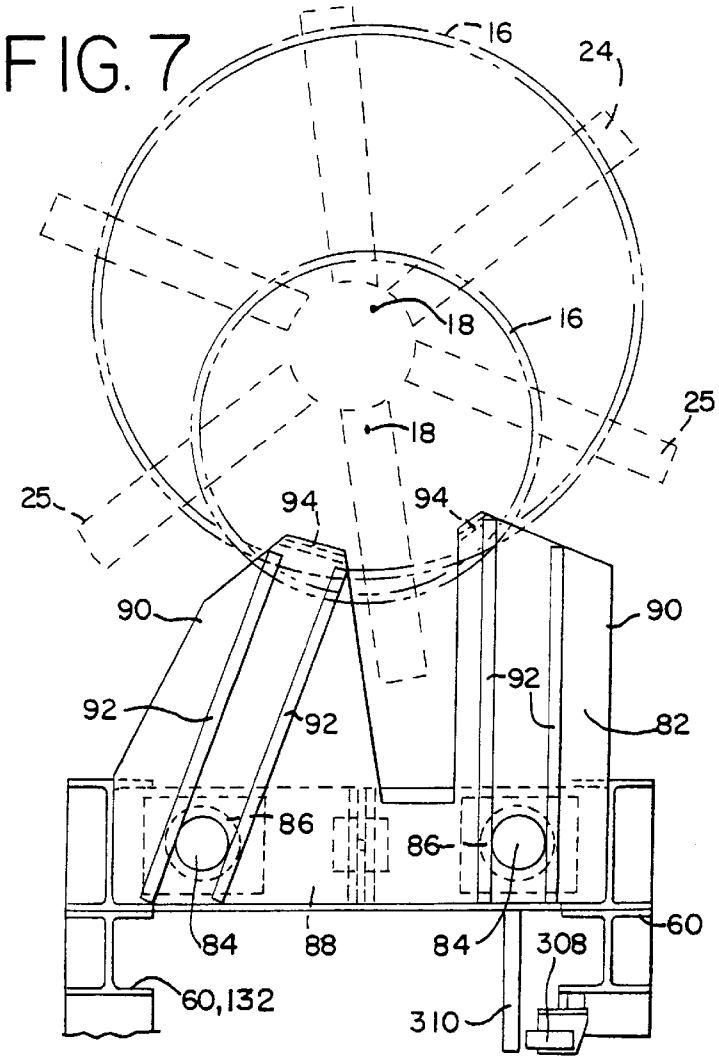
FIG. 7 is an end view taken along line 7—7 of FIG. 4, with parts removed for clarity, showing the non-rolling lower support, with the rails of one of the support stations shown in phantom.

The illustrated lower support plate 82 is shaped to complement the shape of the spaces between an adjacent pair of pipe support rails 25 at one of the pipe support stations 24. As seen in FIG. 7, the lower support plate 82 is shaped so that at least part of the support plate 82 fits into a space between a pair of adjacent rails 25, shown in phantom. As there shown, the support plate 82 has a pair of spaced projections 90 shaped to fit between three adjacent rails 25. The bottom surfaces of the spaced projections 90 include reinforcing ribs 92 and the top surfaces of the free ends of the projections 90 have upstanding retaining lips 94 to fit within the interior of the pipe and limit slipping of the pipe end on the support plate 82. It should be understood that the shape of the illustrated lower support plate is provided for purposes of illustration only; other shapes, such as a rectangle or two rectangular projections, could be used. And if the support station is comprised of structures other than rails, or other than radially-arranged rails, then the shape of the lower support plate 82 would be shaped to fit within an available space at the support station 24 so that the pipe 16 can be placed on and removed from the support station 24, as well as to support at least a part of the end of the pipe or other object.

The illustrated upender 26 and downender 28 each also include a stabilizer 100 movable into a position wherein it can stabilize the pipe 16 as the pipe is tilted between the lowered and raised positions. A stabilizer drive mechanism 102 is also provided to selectively move the stabilizer between a plurality of positions.

Figure 6:
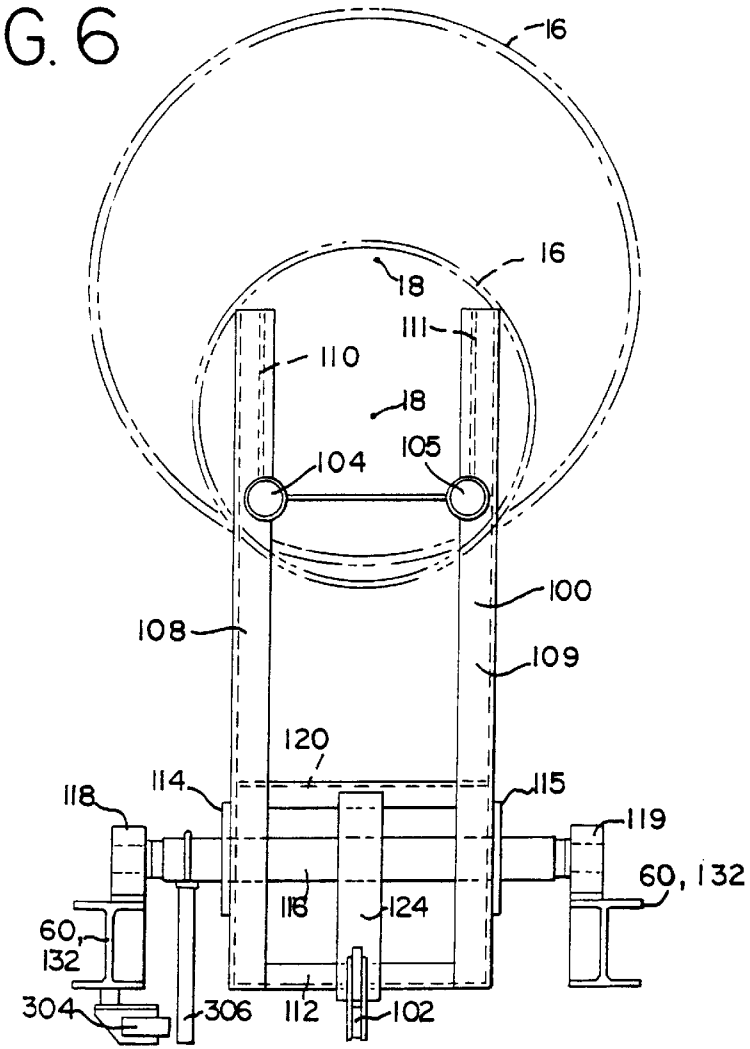
FIG. 6 is an end view taken along line 6—6 of FIG. 3, showing the pipe stabilizer.

An example of a suitable stabilizer 100 is illustrated in FIGS. 3–4 and 6. Each stabilizer 100 includes a pair of spaced parallel arms 104, 105. Each arm has a free end 106. As shown in FIGS. 3–4, the top end 101 of each pipe 16 is open and in communication with an inner channel 103 within the pipe. The stabilizers 100 steady the pipes 16 by placing portions of the arms 104, 105 through the open top ends 101 and into the inner channels 103 of the pipes. As shown in FIG. 6, the two arms 104, 105 of the stabilizer 100 are spaced so that when inserted into the inner channel 103 of the pipe, the arms 104, 105 are slightly spaced from the interior walls of the pipe. Thus, the arms of the illustrated embodiment do not tightly fit within the pipe, but serve to prevent the pipe from tipping over.

In the illustrated embodiment, the arms 104, 105 comprise 3½ inch diameter steel pipe having a length of more than about 3½ feet. The illustrated upender and downender can accommodate pipes of varying lengths, such as pipes having lengths of between a minimum of about 18 feet 5 inches and a maximum of about 20 feet 8 inches. With the minimum length of pipe, about 13 inches of the arms 104, 105 should extend into the inner channel 103 of the pipe to be stabilized. With the maximum length of pipe, about 2 feet 9 inches of the arms 104, 105 should extend into the inner channel 103 of the pipe to be stabilized.

Each arm 104, 105 is fixed to a channel member 108, 109 between the two ends of the channel member 108. Between each arm and the nearest end of the channel member 108, a reinforcing plate 110, 111 is connected to both the channel member and the arm. The opposite end of each channel member 108, 109 is connected to a cross member 112 that connects the two channel members 108, 109. Between the cross member 112 and the arms 104, 105 each channel member 108 is fixed to an apertured plate 114, 115. The apertures of the two plates 114, 115 are aligned and a cylindrical pivot pipe 116 extends through the apertures of the two plates. The two ends of the pivot pipe 116 are received in bushings 118, 119 that are mounted to the frame 60. The pivot pipe 116 can rotate within the bushings 118 so that the stabilizer 100 may be pivoted about the central longitudinal axis of the pivot pipe between the positions shown in solid and phantom lines in FIGS. 3–4. Thus, each stabilizer 100 can be pivoted about an axis normal to the central longitudinal axis 18 of the pipe 16. Generally, the stabilizers 100 should be pivoted into the position shown in solid lines in FIGS. 3–4 whenever the pipe 16 is being tilted and when the pipe is upright on the support plate 82, and the stabilizers 100 should be pivoted out of the way to the position shown in phantom in FIGS. 3–4 when the pipe is being received from the crane, when the upright pipe has been placed on the rails 25 of the support station 24, when the downender 28 is being positioned to remove an upright pipe from the support station 24, and when a pipe is being removed from the downender 28.

The illustrated stabilizer 100 also includes a second cross brace member 120 spaced from the first cross brace member 112. The first and second cross brace members 112, 120 are connected to a central I-beam 124. The central I-beam 124 is connected to the stabilizer drive mechanism 102.

The illustrated stabilizer drive mechanism 102 comprises a hydraulic cylinder 2½ inch bore×22 inch stroke 1⅜ inch diameter rod, 2450 p.s.i. severe service, Series 2H Style SB available from the Parker Hannifin Corp. of Cleveland, Ohio. It should be understood that this drive mechanism is provided for purposes of illustration only; the invention is not limited to this drive mechanism. One end of the cylinder is connected to the frame 60 and the opposite end of the telescoping rod is connected to the central I-beam 124 of the stabilizer 100.

It should be understood that other types of stabilizer structures and stabilizer drive mechanisms could be used. For example, instead of pivoting the stabilizer into place, linear movement could be used. Instead of stabilizing the pipe or other object from the inside of the top end, the stabilizer could comprise arms that encircle part or all of the outer surface of the pipe at some point or points along its length.

To tilt the pipe between the lowered and raised positions, the upender 26 and downender 28 each include a lift mechanism 130 connected to move the pipe 16, the rotator rollers 34, 36, the rolling lower pipe support 62, the non-rolling lower pipe support 64, and the stabilizer 100 so that the pipe is tilted about axis 137 between the raised position and the lowered position and is rotated by the rotator rollers while being tilted through a plurality of angles between the raised and lowered positions. Suitable lift mechanisms for the downender and upender are illustrated in FIGS. 3–4.

As shown in FIGS. 3–4, the frame 60 includes both a tilting portion 132 and a non-tilting portion 134 connected at a frame pivot 136. The non-tilting portion 134 of the frame includes a cross member 138 extending between and connecting two elongate members 140. The pivot 136 may comprise a rod or cylinder connected to the tilting portion and mounted for free rotation within suitable bearings mounted to the non-tilting portion. The pivot 136 defines the substantially horizontal tilt axis, shown at 137 in FIGS. 3–5, that is normal to the central longitudinal axis 18 of the pipe 16. The illustrated lift mechanism comprises a hydraulic cylinder connected to both the tilting portion 132 of the frame and the cross member 138 of the non-tilting portion 134 of the frame. The illustrated lift mechanism is a hydraulic device, with one end of a cylinder pivotally connected to the cross member 138 of the non-tilting frame portion 134 and the opposite end of a rod pivotally connected to a diagonal member 142 on the tilting portion 132 of the frame 60. A suitable hydraulic lift mechanism 130 is a 6 inch bore cylinder×113 inch stroke (working stroke of 99 inches) 3½ inch diameter rod, minimum rating of 2300 p.s.i., Model SB available from Parker Hannifin of Cleveland, Ohio. It should be understood that this lift mechanism is identified for purposes of illustration only.

To allow the upright pipe 16 to be centered on the rails 25 of the support stations 24 at the first location **24*a* and for a centered pipe to be removed from the support stations at the second location 24*b*, the upender and downender each include a linear drive mechanism 150 connected to move the pipe, the non-rolling lower pipe support 64 and stabilizer 100 in a horizontal direction toward and away from one of the support stations 24. In the illustrated embodiment, the linear drive mechanisms 150 are connected to the non-tilting portion 134 of the frame 60 and to a cross member (not shown) connected to two of four stationary frame supports 152. FIG. 4 illustrates the downender before the linear drive mechanism has moved the pipe away from the support station 24**.

Figure 10:
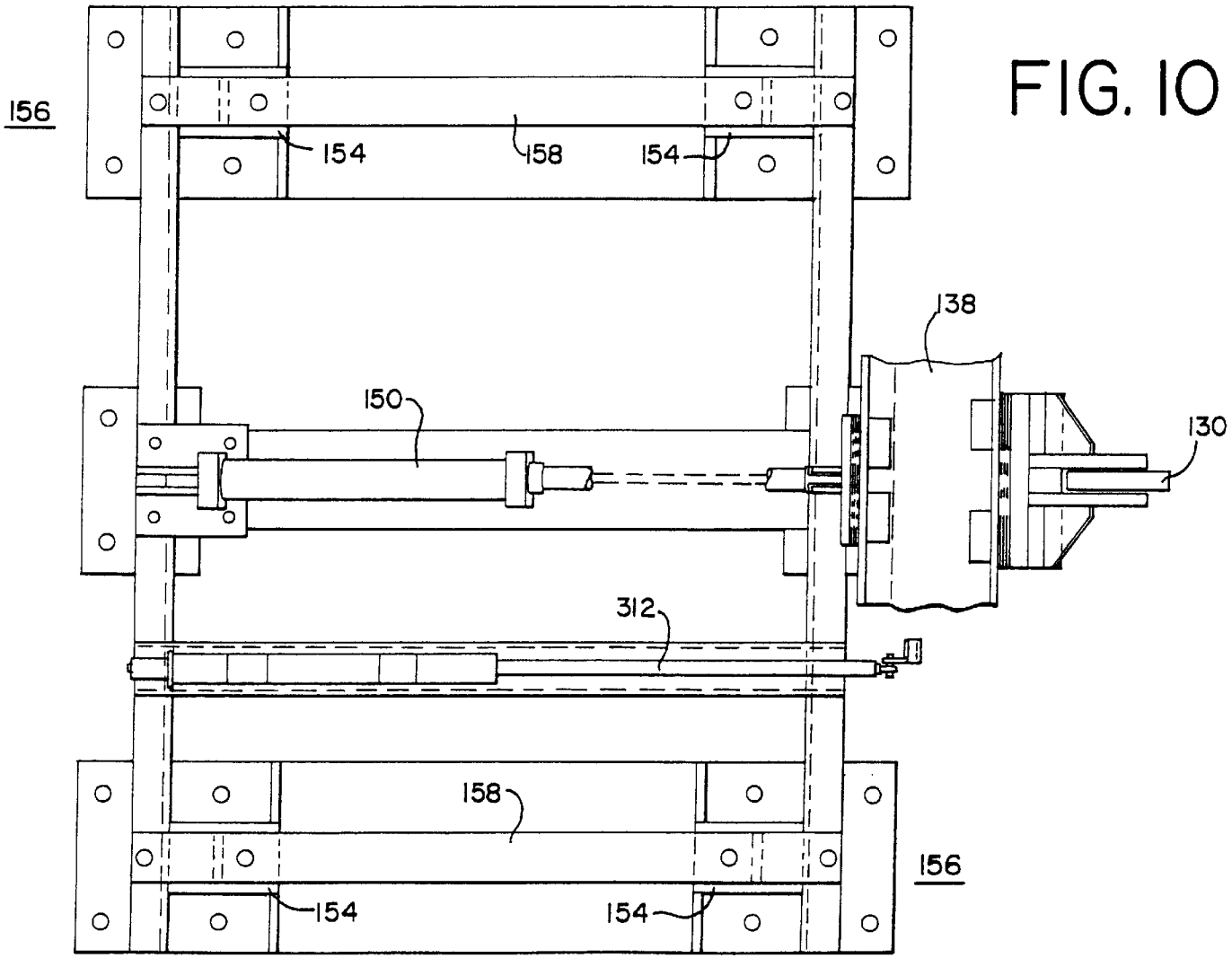
FIG. 10 is a top plan view of the linear drive mechanism of the pipe upender and downender.

As shown in FIGS. 3–4 and 10, each stationary frame support 152 comprises a set of brackets 154 fixed to the factory floor 156 and a rail 158 supported above the floor 156 on the brackets 154. The illustrated rails 158 are about 4 inches wide and about 6 inches high and are made of steel. As shown in FIGS. 3–5, each elongate member 140 of the non-tilting portion 134 of the frame 60 has a pair of vertically-aligned flanged wheels 160, 161 at each end, riding on the top and bottom surface of each rail 158. As shown in FIG. 5, a pair of connecting plates 163, 165 connects each pair of vertically aligned wheels 160, 161. Thus, the frames 60 may be rolled horizontally toward and away from the support stations 24 at positions **24*a* and 24*b* to allow the pipe to be centered on the array of rails 25 at the support station location 24*a* and for a centered pipe to be removed from the array of rails 25 at the support station location 24*b*. Comparing FIGS. 3 and 7, it can be seen that the support plates 82 can be moved toward and away from the center of the radial array of rails 25, with the projections 90 fitting between adjacent rails, through operation of the linear drive mechanism 150**.

A suitable linear drive mechanism 150 for use with the upender and downender is a hydraulic drive. One such hydraulic drive has a 3¼ inch bore cylinder×21 inch stroke 1⅜ inch diameter rod, rated 1500 p.s.i. severe service, available from Parker Hannifin Corp. of Cleveland, Ohio. It should be understood that this device is identified for purposes of illustration only; the invention is not limited to any particular type of drive.

Figures 13, 14, 15:
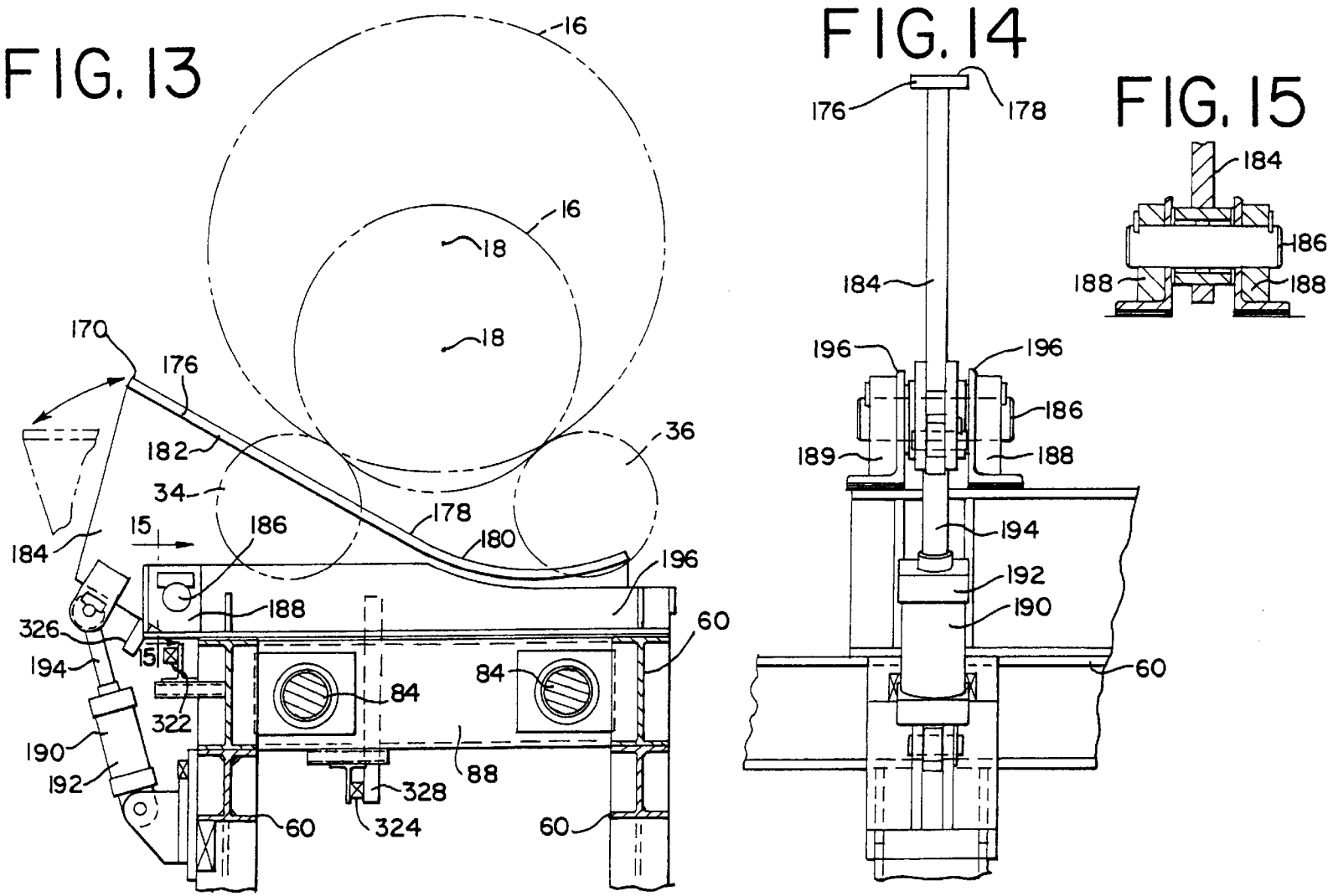
FIG. 13 is an end view taken along line 13—13 of FIG. 3 showing the pipe kick off arm and kick off arm drive mechanism of the pipe downender.
FIG. 14 is an elevation of one kick off arm and kick off arm drive mechanism of FIG. 13.
FIG. 15 is a cross-section taken along line 15—15 of FIG. 13, showing one kick off arm of the pipe downender.

The illustrated downender 28 has a feature that is not present in the illustrated upender 26. As shown in FIGS. 2–4, there are two kick off arms 170, 172 present on the downender 28 to push the horizontal pipe off of the downender and onto a conveying system 174 (shown in FIG. 1) positioned next to the downender 28 and leading to the next station in the production cycle. The structures of the two kick off arms 170, 172, and the following description should be understood as applying to both kick off arms 170, 172. Like reference numbers have been used for like elements of the kick off arms in the drawings and in the description. As shown in FIGS. 13–14, each kick off arm 170, 172 is pivotally mounted to the frame 60 of the downender 28, and comprises a top plate 176 having a top surface 178 having both a curved portion 180 and a straight portion 182. A support plate 184 extends perpendicularly from the top plate 176 toward the frame 60. The support plate 184 is pivotally connected to the frame 60 through a pivot 186 received in two bushings 188, 189. The bushings 188, 189 are fixed to the frame 60. The pivot 186 extends through the support plate 184 near one end, and is aligned beneath the straight portion 182 of the top plate 176. The curved portion 180 of the top plate 176 is at one end of the top plate 176 and underlies the pipe 16 when the pipe is supported on the rollers 34, 36, as shown in FIG. 13. At the opposite end of the top plate 176 is the straight portion 182.

A drive mechanism 190 is provided to selectively pivot each kick off arm 170, 172 about the pivot 186. The drive mechanism 190 in the illustrated embodiment comprises a hydraulic drive, with a hydraulic cylinder 192 pivotally connected at one end to the frame 60 and a telescoping rod 194 pivotally connected at one end to the support plate 184 near the end of the straight section 182 of the top plate 176. To guide the motion of the kick off arm, the support plate may be sandwiched between guide walls 196. A suitable hydraulic drive mechanism is a 4 inch bore cylinder×5⅜ inch stroke 1¾ inch diameter rod device rated 1850 p.s.i. severe service available from Parker-Hannifin Corp. of Cleveland, Ohio. It should be understood that this drive mechanism is identified for purposes of illustration only, and that the present invention is not limited to any particular drive mechanism.

As will be understood by those skilled in the art, the upender 26 and downender 28 should preferably include a plurality of sensors to determine the position of the upender and downender and the position of the pipe. Moreover, it is necessary that the upender place the pipe in the proper centered location on the rails 25 of the support station 24 at the first location 24*a*; suitable sensors may be provided in the vicinity of the support stations 24. Limit switches may be provided for this and other purposes, placed to sense and indicate the positions of the stabilizer 100 and rolling and non-rolling lower pipe supports 62, 64, whether the rotators 30, 32 are rotating, the positions of the kick off arms 170, 172, the angular position of the frame 60 or pipe 16, and the linear position of the frame 60 or pipe. For example, as shown in FIG. 5, there may be a plurality of limit switches 300 and trip arms 302 for providing data for control of the vertical tilt of the tilting portion 132 of the upender and downender frame 60 so that the speed and operation of the lift mechanism 130 may be controlled. As shown in FIG. 6, a limit switch 304 may be provided on the frame 60 and a trip arm 306 on the pivot pipe 116 so that data may be provided for control of the stabilizer 100. As shown in FIGS. 7 and 9, one or more limit switches 308 may be provided on the frame 60 and a trip arm 310 mounted on one of the mechanical tubes 84 of the non-rolling lower pipe support 64 to provide data for control of the drive mechanism 80 of the non-rolling pipe support 64. For the rolling pipe support 62, a trip arm (not shown) may be mounted to turn with rotation of the rotatable shaft 72 and limit switches (not shown) may be mounted to the frame to provide data on the position of the rollers 66 for control of the drive mechanism 78 of the rolling lower support 62. A linear transducer 312 as shown in FIG. 10 may be used to provide data on the linear position of the frame 60 for control of the linear drive mechanism 150. A limit switch 314 may be provided on the frame 60 near each rotator 30, 32, with a sprocket 316 carrying trip arms 318 placed nearby. The sprocket 316 may be connected through a chain 320 to rotate with the idler sprocket 56 so that data on rotation of the rollers 34, 36 may be available for control of the roller drive mechanisms 42, 44. As shown in FIG. 13, limit switches 322, 324 may be mounted to the frame 60 near the kick off arms 170, 172 of the downender, with trip arms 326, 328 mounted to portions of the kick off arms to provide data for control of the drive mechanisms 190 of the kick off arms. Photoelectric devices (not shown) may also be positioned to sense and indicate the presence of a pipe on the upender and downender. It should be understood that these control mechanism are identified for purposes of illustration only, and that other devices and controls for operation of the upender and downender may be employed.

Figure 16:
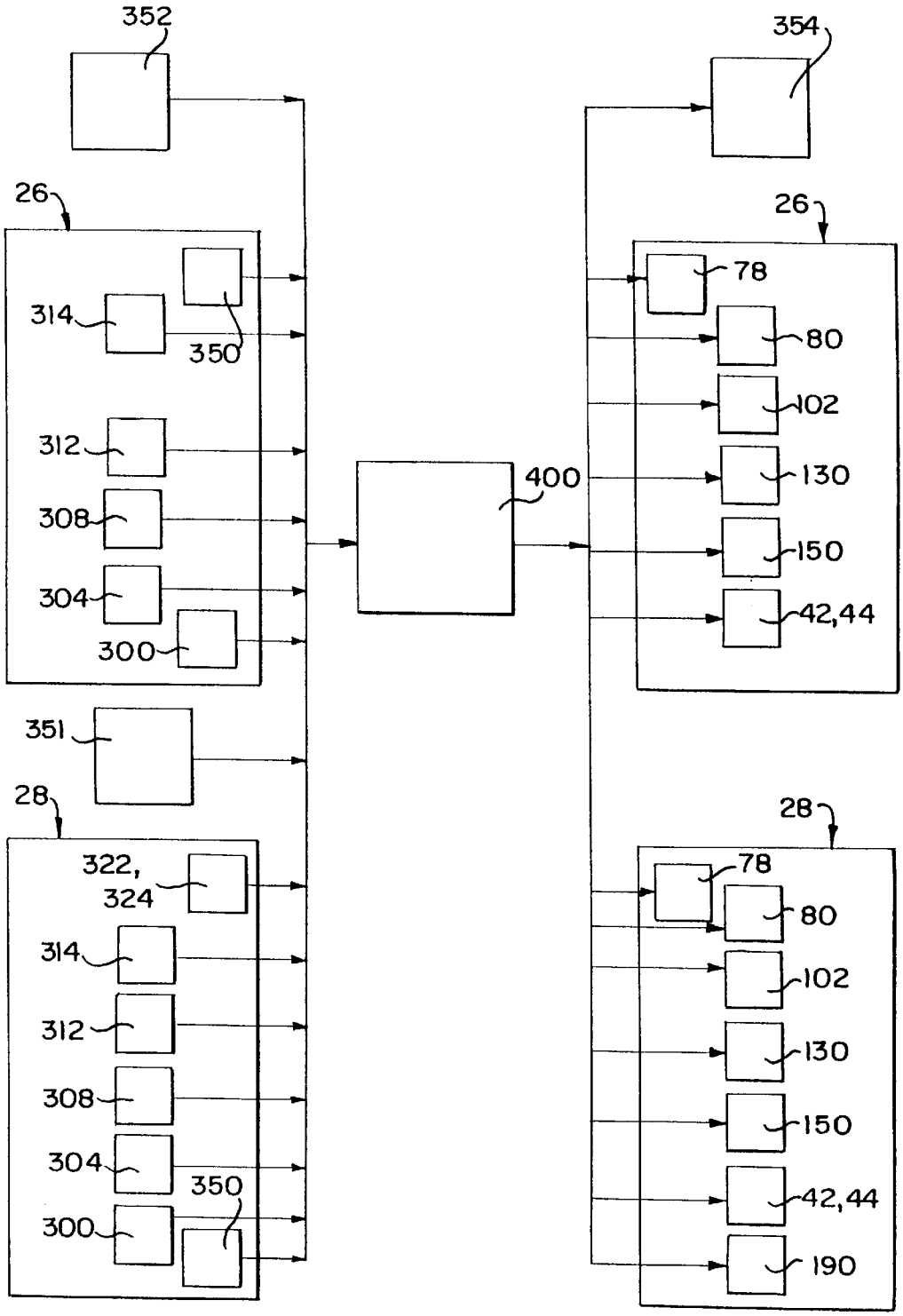
FIG. 16 is a schematic of an example of inputs and outputs for computer control of the system and method of the present invention.

The electrical outputs of the various sensors may be fed to a central control apparatus, such as a suitably programmed computer 400. As shown in the schematic FIG. 16, the computer or central processing unit 400 may receive inputs from the limit switches 300, 304, 308, 312, and 314 for both the upender and downender. Data from additional limit switches, shown at 350 in FIG. 16, for the position of the rolling lower pipe supports 62 may also be input to the computer 400, as well as data from any photoelectric devices, shown at 351 in FIG. 16. Additional data input should be provided from the furnace carousel 23, to indicate whether the support station is empty and whether the carousel is moving or stationary and ready to receive a pipe. For the downender, data from the kick off arm limit switches 322, 324 may also be input to the computer 400, as well as data from the furnace carousel to indicate whether a pipe is present, and whether the carousel is moving or stationary and ready for a pipe to be picked up. Provision may also be made for operator input, shown at 352 in FIG. 16, for data such as pipe diameter. The computer 400 may be connected to control operation of the various moving parts of the upender and downender. For example, as shown in FIG. 16, the computer 400 may control the rolling support drive mechanism 78 to extend and retract the rollers 66, the non-rolling lower support drive mechanism 80 to raise and lower the main support plate 82, the stabilizer drive mechanism 102 to raise and lower the stabilizer 100, the lift mechanism 130 to raise and lower the tilting portion 132 of the frame 69, the linear drive mechanism 150 to push or pull the frame 60 on the rails 158, the roller drive mechanisms 42, 44, and the kick off arm drive mechanisms 190 to extend and retract the kick off arms 170, 172. Thus, the operation of the upender and downender may be totally automated. Preferably, the upender and downender are automatically controlled so that the operation of the upender and downender does not interfere with operation of the annealing furnace. A visual display, audible alarm or other output device, shown generally at 354 in FIG. 16, may also be connected to the computer. The computer may comprise a standard commercially available programmable logic and motion control system (PLC) available from Allen-Bradley Co., Lebanon, N.H., with standard ladder logic suitably programmed, as will be understood by those skilled in the art. A standard PLC with standard logic may be programmed by one skilled in the programming art, such as an electrical engineer, or more sophisticated programming could be developed if desired. It should be understood that this computer control is identified for purposes of illustration only, and that the invention is not limited to any particular program, computer or PLC.

In operation, as the pipe exits the casting machine at the first production station, the pipe is substantially horizontal, typically at a slight angle from 0°. The pipe may be moved from the first production station 12 by lifting with a crane 20 that also rotates the pipe about the pipe's central longitudinal axis 18 as the pipe is transported to the upender 26 positioned between the production stations 12, 14. Typically, the crane would move the pipe in a substantially horizontal position. The substantially horizontal pipe 16 may then be placed on the upender 26 with its central longitudinal axis 18 substantially horizontal and with its bell end 22 near the rolling and non-rolling lower supports 62, 64 of the upender 26. This initial position of the pipe comprises the lowered position, and the angle comprises the first angle. As discussed above, this first angle may be greater than 0°, and the lowered position need not correspond with horizontal.

Once the presence of the pipe on the upender 26 is sensed, the roller drive mechanisms 42, 44 are activated to begin to rotate the rollers 34, 36 to thereby rotate the pipe 16 about its central longitudinal axis 18. The rolling lower support drive mechanism 78 is activated to extend the rollers 66 and position them at the rim at the bell end 22 of the pipe 16. At this stage, the main support plate 82 of the non-rolling lower pipe support 64 is extended to be spaced away from and out of contact with the bell end 22 of the pipe 16. The stabilizer drive mechanism 102 is then activated to move the stabilizer 100 from the retracted position shown in phantom lines in FIG. 3 to the extended position shown in solid lines in FIG. 3. The stabilizer drive mechanism 102 thus pivots the stabilizer about the pivot pipe 116 until the free ends 106 of the stabilizer arms 104, 105 are received within the inner channel 103 of the pipe 16. The lift mechanism 130 is then activated to begin to tilt the tilting portion 132 of the frame 60 upward on the pivot 136 about horizontal axis 137, to thereby tilt the pipe 16 upward about the tilt axis 137 toward vertical. The first and second rotators 30, 32 continue to operate as the frame and pipe are tilted upward through a plurality of angles between horizontal and vertical, so that the pipe is simultaneously rotated about its central longitudinal axis 18 and tilted about pivot axis 137 up to an angle of about 75° from the horizontal. The rollers 66 of the rolling pipe support 62 support the weight of the pipe as the pipe is tilted while also permitting the pipe to rotate.

At an angle of about 75° from the horizontal, the roller drive mechanisms 42, 44 are disengaged and the pipe 16 stops rotating. The non-rolling lower pipe support drive mechanism 80 is then activated to retract the main support plate 82, pulling the main support plate into contact with the rim at the bell end 22 of the pipe, and with the retaining lips 94 within the inner channel 103 of the pipe 16. The rolling lower pipe support drive mechanism 78 is then activated to retract the rollers 66 away from the pipe so that the rollers are out of contact with the pipe. The bell end of the pipe is then supported solely by the main support plate 82. The lift mechanism 130 continues to tilt the tilting portion 132 of the frame 60 and the pipe toward the vertical reference 19, until the pipe reaches the raised position with its central longitudinal axis 18 at a second angle $\alpha$. As discussed above, in the illustrated embodiment the raised position corresponds with the desired upright processing position of the pipe, and the second angle $\alpha$ is about 90° from the horizontal reference 17. As discussed above, the second angle $\alpha$ may deviate from the vertical.

The linear drive mechanism 150 is activated to push the entire frame 60 horizontally on its rollers 160, 161 along the rails 158 of the stationary frame supports 152, thereby moving the raised pipe horizontally, until the central longitudinal axis 18 of the pipe 16 is centered over the center of the radial array of rails 25 at the support station 24 at the first support station location 24*a*.

It may be desirable to first back up the frame 60 horizontally on the rollers, away from the carousel 23 and support station 24 to allow sand from the sand core used in the casting process to drop out of the bell end of the pipe. Thus, the sand will not fall onto the support station, and the sand will not interfere with proper seating of the pipe on the support surfaces of the support station 24.

Once the raised pipe is aligned with its central longitudinal axis 18 centered over the array of support rails 25, the non-rolling lower pipe support drive mechanism 80 is then activated to extend the main support plate 82 downward toward the support station 24. As the main support plate 82 moves downward, its spaced projections 90 fit into the spaces between three adjacent rails 25 of the radial array of the support station 24 at the first support station location 24*a*. The main support plate 82 continues to move downward until the rim of the bell end 22 of the pipe rests upon the top surfaces of the rails 25 and the main support plate 82 is spaced below the pipe. The bell end of the pipe is then supported solely by the rails 25 of the support station at first support station location 24*a*. The stabilizer drive mechanism 102 is then activated to pivot the stabilizer 100 about its pivot pipe 116, to raise the free ends 106 of the arms 104, 105 out of the pipe until the free ends 106 are spaced above the top end 101 of the pipe. The linear drive mechanism 150 is then activated to pull the entire frame 60 in a horizontal direction away from the upright pipe supported on the rails of the support station 24 at the first support station location 24*a*. Once the frame 60, stabilizer 100, and lower pipe supports 62, 64 are spaced from the raised pipe, the raised tilting portion 132 of the frame may be tilted downward toward the horizontal by activating the lift mechanism 130 to retract the rod into the cylinder. Once the tilting portion 132 of the frame is lowered and resting on the non-tilting portion 134, the upender 26 is ready to receive another pipe from the casting station via the overhead crane 20. The upright pipe is then in the processing position on the rails 25 of the support station 24 at the first support station location 24*a* as shown in FIG. 2.

With the pipe 16 in the processing position, the support station 24 and pipe may be moved from the first support station location 24*a* by indexing into and through the heat treating furnace 15 for annealing. In the illustrated embodiment, the carousel 23 supporting the support station 24 is mounted on wheels 200 that roll on tracks 202, with a drive mechanism to index the carousel 23, support stations 24 and upright pipes through the furnace. Since the pipes 16 are upright as they are moved through the heating and cooling zones of the furnace, the pipes should retain the desired shape through the annealing process without rotation about the central longitudinal axis 18. The upright pipes and support stations 24 are indexed through and out of the furnace 15 until one of the support stations 24 reaches the second support station location 24*b* downstream of the heat treating furnace 15 part of the second production station 14. When the upright pipe 16 and support station 24 are at the second support station location 24*b*, the upright pipe and the support station are aligned with the pipe downender 28, as shown in FIG. 2.

To retrieve an upright pipe that is present on the support station 24 at the second support station location 24*b*, the tilting portion 132 of the downender frame 60 is raised by the lift mechanism 130, while the linear drive mechanism 150 is in the retracted position so that the downender is spaced from the support station 24. The linear drive mechanism 150 is then activated to push the downender frame 60 horizontally on its wheels along the rails 158 toward the support station 24 at the second support station location 24*b*. The spaced projections 90 of the main support plate 82 on the raised tilting portion 132 are pushed horizontally between three rails 25 below the rim of the bell end 22 of the upright pipe 16 that is supported on the rails. The stabilizer 100 is then pivoted from the retracted position shown in phantom lines in FIG. 4 to the extended position shown in solid lines FIG. 4, with the free ends 106 of the arms 104 within the inner channel 103 of the upright pipe 16. The non-rolling lower pipe support drive mechanism 80 is then activated to retract the main support plate 82 upward toward the bell end 22 of the pipe until the main support plate contacts the rim of the bell end of the pipe and raises the pipe upward off of the rails 25 as shown in FIG. 4.

After the pipe is lifted from the rails 25, the linear drive mechanism 150 is activated to pull the entire downender frame 60 horizontally away from the support station at the second support station location 24*b*. The lift mechanism 130 is then activated to begin tilting the tilting portion 132 of the frame about the axis 137 of the pivot 136 downward toward the horizontal. The rolling lower pipe support drive mechanism 78 is then activated to extend the rollers 66 toward the pipe until the rollers are positioned beneath the rim of the bell end 22 of the pipe. The lift mechanism 130 may then be activated to retract, to begin tilting the tilting portion 132 of the frame 60 and the pipe 16 away from the vertical. The non-rolling lower pipe support drive mechanism 80 may be activated to extend the main support plate 82 away from the bell end 22 of the pipe, leaving the rim of the bell end of the pipe resting on the rollers 66 of the rolling lower pipe support 62. The lift mechanism 130 continues to retract, tilting the pipe downward about axis 137 until it reaches an angle of about 75° from the horizontal. At about that angle, the roller drive mechanisms 42, 44 may be activated to rotate the rollers 34, 36, to thereby rotate the pipe 16 about its central longitudinal axis 18. The pipe is rotated by the rotators 30, 32 about its axis 18 while the pipe simultaneously tilts downward toward horizontal about axis 137, and this rotation continues as the pipe is tilted through a plurality of angles between vertical and horizontal until the pipe is in the desired final lowered position shown in FIG. 3. The lowered position may be with the central longitudinal axis 18 of the pipe substantially horizontal.

When the pipe is in the lowered position at the desired final angle, the roller drive mechanisms may be deactivated and the drive mechanisms 190 for the kick off arms 170, 172 may be activated. The drive mechanisms for the kick off arms cause the kick off arms to turn about the pivots 186, pulling downward on the support plates 184 to pull the straight portions 182 of the top plates 176 downward and pivot the curved portions 180 of the top plates 176 upward into contact with the pipe outer surface to push the lowered pipe off of the downender 28 and onto the adjacent conveying system 174 for further operations.

Although the illustrated embodiment of the present invention shows a heat treating furnace and support stations with a circular carousel, it should be understood that other types of carriage for the support stations and through a heat treating furnace could be employed, such as a linear system, in which case the upender and downender would be spaced apart, with the upender at the upstream end of the annealing furnace and the downender at the downstream end of the annealing furnace.

Although the illustrated embodiment of the present invention shows a cast metal pipe as the object being moved between production stations, it should be understood that the principles of the present invention may be applied to the production of other objects as well. And although the illustrated embodiment of the present invention shows a casting machine and an annealing furnace at the first and second production stations 12, 14, it should be understood that the present invention is not limited to use at such production stations.

While only a specific embodiment of the invention has been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

I claim:

1. An apparatus for moving an object with two ends between lowered and raised positions comprising:

a rotator having a plurality of spaced rollers for supporting and selectively rotating the object about one axis;

a roller drive mechanism for selectively causing the rollers to rotate;

a lift mechanism for tilting the object about a second axis to move the object between the lowered and raised positions;

a non-rolling lower support movable into a position wherein it supports one end of the object when the object is free from rotational movement; and a drive mechanism to move the non-rolling lower support between a plurality of positions.

2. The apparatus of claim 1 further comprising a rolling lower support having a roller movable into a position contacting one end of the object when the object is rotating and a drive mechanism to move the rolling lower support between a plurality of positions.

3. The apparatus of claim 2 further comprising a stabilizer movable into a position wherein it can stabilize the object as the object is tilted through a plurality of angles.

4. The apparatus of claim 3 wherein the lift mechanism is connected to move the rollers, non-rolling lower support, rolling lower support and stabilizer with the object as the object is tilted between the lowered and raised positions.

5. The apparatus of claim 4 further comprising a linear drive mechanism connected to move the object, non-rolling lower support and stabilizer in a horizontal direction.

6. The apparatus of claim 5 further comprising a frame having a tilting portion, a non-tilting portion and a pivot connecting the tilting and non-tilting portions, the rotator rollers, rolling lower support, non-rolling lower support and stabilizer being connected to the tilting portion of the frame.

7. A system for moving objects from one production station to another production station, each object having two ends and a central longitudinal axis, the system comprising:

a first production station;

a second production station including a plurality of movable support stations for supporting objects, each support station for supporting one object in a substantially upright position wherein the central longitudinal axis of the object is substantially vertical and for moving the substantially upright object through at least part of the second production station, each support station being movable to a plurality of locations;

an upender for tilting one object from a non-upright position upward toward vertical, the upender having a tilting portion for supporting one object and pivotable about a substantially horizontal axis, the upender further including a lift mechanism connected to the tilting portion for selectively turning the tilting portion about the substantially horizontal axis, the upender being aligned with a first support station location and positioned to place a substantially upright object on the support station at the first support station location; and a downender for tilting one object from one position downward toward horizontal to a non-upright position, the downender having a tilting portion for supporting one object and pivotable about a substantially horizontal axis, the downender further including a lift mechanism connected to the tilting portion for selectively turning the tilting portion about the substantially horizontal axis, the downender being aligned with a second support station location and positioned to remove an object from the support station at the second support station location.

8. The system of claim 7 wherein the second production station includes a heat treating furnace and wherein the first support station location is upstream of the heat treating furnace and wherein the second support station location is downstream of the heat treating furnace, each support station being movable from the first support station location, through the heat treating furnace and to the second support station location.

9. The system of claim 8 wherein the first production station includes a casting machine.

10. The system of claim 7 wherein the upender further includes a rotator on the tilting portion, the rotator having a plurality of rollers for supporting and selectively rotating the object about the central longitudinal axis of the object, and wherein the downender further includes a rotator on the tilting portion for supporting and selectively rotating the object about the central longitudinal axis of the object.

11. The system of claim 7 wherein the upender further includes a linear drive mechanism connected to move at least part of the upender in a substantially horizontal direction toward and away from the support station at the first support station location and wherein the downender further includes a linear drive mechanism connected to move at least part of the upender in a substantially horizontal direction toward and away from the support station at the second support station location.

12. The system of claim 7 wherein the upender further comprises:

a rotator mounted on the tilting portion, the rotator having a plurality of rollers for supporting and selectively rotating the object;

a roller drive mechanism for selectively causing the rollers to rotate;

a non-rolling lower support mounted on the tilting portion, the non-rolling lower support movable into a position wherein it supports a first end of the object and into a position spaced from the first end of the object;

a rolling lower support mounted on the tilting portion, the rolling lower support having rollers and movable into a position wherein the rollers contact the first end of the object and into a position spaced from the first end of the object;

a drive mechanism to move the non-rolling lower support between a plurality of positions;

a drive mechanism to move the rolling lower support between a plurality of positions;

a stabilizer mounted on the tilting portion, the stabilizer being movable into a position wherein it can stabilize the object as the object is tilted;

a stabilizer drive mechanism to move the stabilizer between a plurality of positions;

and wherein the downender further comprises:

a rotator having a plurality of rollers for supporting and selectively rotating the a roller drive mechanism for selectively causing the rollers to rotate;

a non-rolling lower support movable into a position wherein it supports a first end of the object and into a position spaced from the first end of the object;

a rolling lower support having rollers and movable into a position wherein the rollers contact the first end of the object and into a position spaced from the first end of the object;

a drive mechanism to move the non-rolling lower support between a plurality of positions;

a drive mechanism to move the rolling lower support between a plurality of positions;

a stabilizer movable into a position wherein it can stabilize the object as the object is tilted; and a stabilizer drive mechanism to move the stabilizer between a plurality of positions.

13. The system of claim 12 wherein the second production station includes a heat treating furnace and wherein the first support station location is upstream of the heat treating furnace and wherein the second support station location is downstream of the heat treating furnace, each support station being movable from the first support station location, through the heat treating furnace and to the second support station location.

14. The system of claim 13 wherein the first production station includes a casting machine.

15. The system of claim 14 wherein the upender further includes a non-tilting portion pivotally connected to the tilting portion and a linear drive mechanism connected to move the tilting and non-tilting portions in a substantially horizontal direction toward and away from the support station at the first support station location and wherein the downender further includes a non-tilting portion pivotally connected to the tilting portion and a linear drive mechanism connected to move the tilting portion and non-tilting portions in a substantially horizontal direction toward and away from the support station at the second support station location.

16. The system of claim 15 wherein each support station comprises a plurality of spaced rails and wherein each non-rolling support includes a plate having a portion shaped to fit between a pair of rails on one support station.

17. In combination, an object having two ends and a central longitudinal axis and a system for moving the object from one production station to another production station, the system comprising:

a first production station for producing objects;

a second production station downstream of the first production station and including a plurality of movable support stations for supporting objects, each support station for supporting one object in a substantially upright position wherein the central longitudinal axis of the object is substantially vertical and for moving the substantially upright object through at least part of the second production station, each support station being movable to a plurality of locations;

an apparatus for moving objects, the apparatus being positioned between the first and second production stations to receive an object from the first production station and move the object to the second production station, the apparatus supporting at least one object in a substantially upright position wherein the central longitudinal axis of the object is substantially vertical, the apparatus including a rotator having a plurality of spaced rollers for selectively rotating the object about the central longitudinal axis of the object and a lift mechanism for tilting the object about a second axis to move the object between the upright position and another position wherein the central longitudinal axis of the object is non-vertical, the central longitudinal axis of the object being aligned with at least part of one of the support stations of the second production station.

18. The combination of claim 17 wherein the apparatus further comprises a non-rolling lower support contacting one end of the object.

19. The combination of claim 18 wherein the apparatus further comprises a rolling lower support spaced from the object and having rollers movable into contact with one end of the object.

* * * * *